US006112570A

United States Patent [19]

Hruschak

[11] Patent Number: 6,112,570

[45] Date of Patent: Sep. 5, 2000

[54] METHOD FOR MAKING SLOTS IN METAL PIPE

[75] Inventor: Lawrence Alexander Hruschak, 8726-61 Avenue, Edmonton, Alberta, Canada, T6E 5P6

[73] Assignees: Laurie Alfred Venning; Terry James Mclean, both of Sherwood Park; Lawrence Alexander Hruschak, Edmonton, all of Canada

[21] Appl. No.: 09/242,132

[22] PCT Filed: Aug. 8, 1997

[86] PCT No.: PCT/CA97/00562

§ 371 Date: Apr. 15, 1999

§ 102(e) Date: Apr. 15, 1999

[87] PCT Pub. No.: WO98/06535

PCT Pub. Date: Feb. 19, 1998

[30] Foreign Application Priority Data

Aug. 9, 1996 [CA] Canada ..... 2183032

[51] Int. Cl.[7] ..... B21D 28/28

[52] U.S. Cl. ..... 72/370.27; 72/203

[58] Field of Search ..... 72/70, 203, 370.27, 72/252.5

[56] References Cited

U.S. PATENT DOCUMENTS 1,207,808 12/1916 Steps ..... 72/203

2,306,945 12/1942 Hebron ..... 72/181

*Primary Examiner*—Lowell A. Larson

*Attorney, Agent, or Firm*—Davis and Bujold

[57] ABSTRACT

A method for making slots in metal pipe and, in particular, slots less than 15 thousandths of an inch in width. Firstly, providing a metal pipe (10) having an exterior surface (12) and an interior surface (14) which defines an axially extending interior bore (16). Secondly, cutting an axially extending elongate slot (18) having a width that is larger than desired in the pipe (10) with a cutting tool, the slot (18) providing fluid communication from the exterior surface (12) to the interior surface (14), the slot (18) having longitudinal peripheral edges (20). Thirdly, applying pressure to the exterior surface (12) of the pipe (10) along at least one of the longitudinal peripheral edges (20) of the slot (18) until the metal pipe (10) is deformed sufficiently to close the slot (18) to a desired width.

4 Claims, 1 Drawing Sheet

METHOD FOR MAKING SLOTS IN METAL PIPE

FIELD OF THE INVENTION

The present invention relates to a method for making slots in metal pipe and, in particular, slots less than 15 thousandths of an inch in width.

BACKGROUND OF THE INVENTION

The oil industry uses slotted metal pipe as a screening mechanism when drilling for heavy oil. Heavy oil is commonly found in oil bearing sand formations. Oil wells are drilled that have horizontal sections, which can be 1000 meters or more in length. These horizontal sections have a tendency to collapse and become filled with sand. In order to prevent this from occurring, slotted metal pipe is placed in the horizontal sections. The sand is supported by the metal pipe, while the heavy oil seeps through the slots into the pipe where it can be pumped to surface.

It is not unusual for the slots to have a width of between 25 and 15 thousandths of an inch. Even with slots of that width, some sand enters the pipe. In order to further restrict the entry of sand into the pipe, the industry is demanding slots of less than 15 thousandths of an inch. It has yet to be determined how small the slots can be without unduly restricting the rate of flow into the pipe. It has been speculated that between 5 and 7 thousandths of an inch will be optimum. Unfortunately, most slot cutting equipment is unable to cut slots with a width of less than 15 thousandths of an inch. German Offenlegungsschrift DE 32 13 46 A1 discloses slot cutting equipment capable of cutting multiple slots around a circumference of a pipe. The reference discloses a support for supporting a pipe in a horizontal orientation and a plurality of cutting heads positioned along the axial length of the pipe.

SUMMARY OF THE INVENTION

What is required is a method for making slots in metal pipe that is better suited for making slots less than 15 thousandths of an inch in width.

According to the present invention there is provided a method for making slots in metal pipe. Firstly, providing a metal pipe having an exterior surface and an interior surface which defines an axially extending interior bore. Secondly, cutting an axially extending elongate slot having a width that is larger than desired in the pipe with a cutting tool. The slot extends through the pipe providing fluid communication from the exterior surface to the interior surface. The slot has longitudinal peripheral edges. Thirdly, applying pressure to the exterior surface of the pipe along at least one of the longitudinal peripheral edges of the slot until the metal pipe is deformed sufficiently to close the slot to a desired width.

With the method, as described above, short comings in cutting equipment are overcome by applying pressure until the material surrounding the slot yields to narrow the slot to a desired width. There are a variety of ways that this can be done. A preferred manner of applying pressure is by means of a roller.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The preferred method for making slots less than 15 thousandths of an inch in width in metal pipe will now be described with reference to FIGS. 1 through 3.

Figure 1:
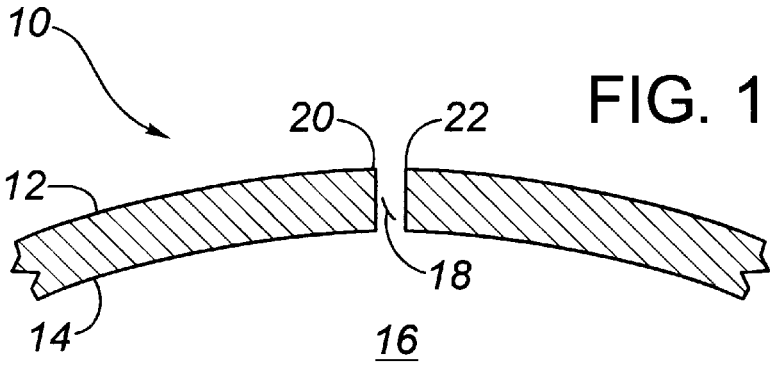
FIG. 1 is a side elevation view, in cut away section, of a pipe which is in the process of being slotted in accordance with the teachings of the present method.

Referring to FIG. 1, firstly, provide a metal pipe 10 having an exterior surface 12 and an interior surface 14 which defines an axially extending interior bore 16. Secondly, cut an axially extending elongate slot 18 having a width that is larger than desired in metal pipe 10 with a cutting tool (not shown). The cutting tool can take various forms from milling machines to lasers. Slot 18 extends through pipe 10 providing fluid communication from exterior surface 12 to interior surface 14. Slot 18 has longitudinal peripheral edges 20 and 22. To this point the steps involved in the preferred method do not materially differ from the steps taken in the prior art. In the prior art, slot 18 would be cut precisely to the desired width. With the present method, slot 18 is deliberately cut having a width that is larger than desired, as a preliminary step in the method.

Figure 2:
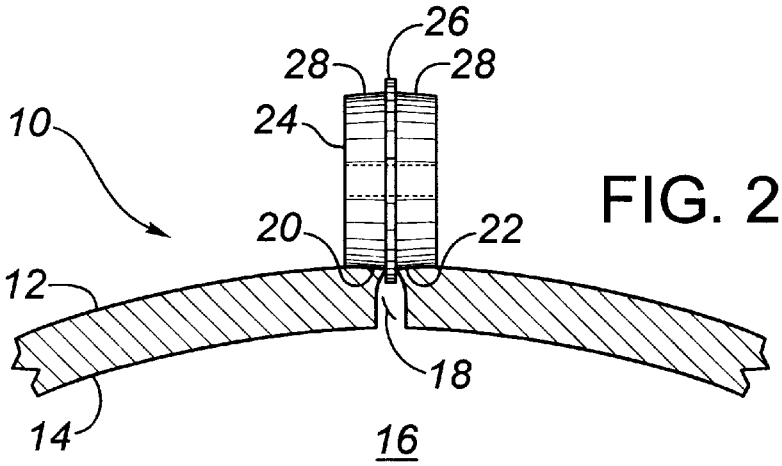
FIG. 2 is a side elevation view, in cut away section, of a slot in the pipe illustrated in FIG. 1, being treated by a pressure roller.

Referring to FIG. 2, thirdly, applying pressure to exterior surface 12 of pipe 10 along one or both of longitudinal peripheral edges 20 and 22 of slot 18 until metal pipe 10 is deformed sufficiently to close slot 18 to a desired width. The key to the present method is to apply pressure that exceeds the yield strength of the material to narrow the slot. There are a variety of means by which this may be done. For example, by means of a stamp or punch, by means of a seaming tool. The preferred manner of applying pressure, however, is by means of a roller 24, as illustrated. The use of roller 24 has a number of advantages. Roller 24 can be equipped with a guide flange 26 that centers roller 24 in slot 18 and limits the deformation of the material when pressure is applied. The pressure on roller 24 can be regulated more easily than other methods. Roller 24 can be shaped with sloping contact surfaces 28 that help localize the pressure along longitudinal peripheral edges 20 and 22 to achieve the desired deformation. Roller 24 is viewed as being more readily incorporated into mechanized slot cutting equipment.

Figure 3:
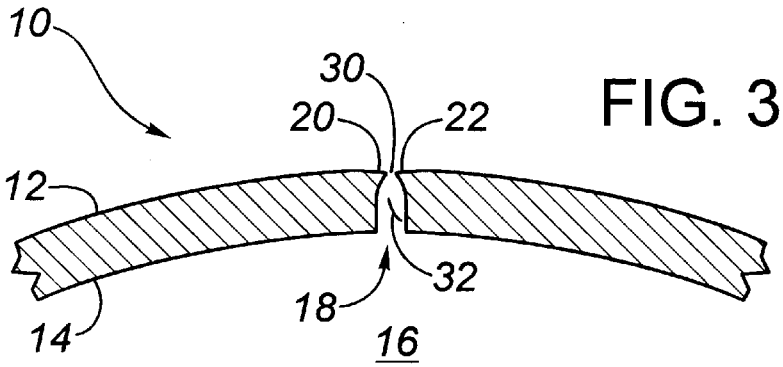
FIG. 3 is a side elevation view, in cut away section, of a pipe that has been slotted in accordance with the teachings of the present method.

Referring to FIG. 3, there is illustrated slot 18 after it has been narrowed by roller 24. The resulting slot 18 has desirable properties for the intended screening application. It has a narrow opening 30 of 5 thousandths of an inch at exterior surface 12. Fast opening 30 it has an enlarged portion 32 of 15 thousandths of an inch or wider. This is desirable as grains of sand fine enough to temporarily wedge into narrow opening 30 will tend to be pushed by pressure through enlarged portion 32 into interior bore 16 of pipe 10, rather than blocking of slot 16. Enlarged portion 32 also results in a decrease in pressure loss across narrow opening 30 of slot 18.

It will be apparent to one skilled in the art that modifications may be made to the illustrated embodiment without departing from the scope of the invention as hereinafter defined in the Claims.

What is claimed is:

1. A method for making slots (18) in metal pipe (10), comprising the steps of:

firstly, providing a metal pipe (10) having an exterior surface (12) and an interior surface (14) which defines an axially extending interior bore (16);

secondly, cutting an axially extending elongate slot (18) having a width that is larger than desired in the pipe (10) with a cutting tool, the slot (18) providing fluid communication from the exterior surface (12) to the interior surface (14), the slot (18) having longitudinal peripheral edges (20) that are substantially coterminous with the exterior surface (12); and thirdly, applying pressure to the exterior surface (12) of the pipe (10) along each of the longitudinal peripheral edges (20) of the slot (18) with a convex roller having sloping contact surfaces (28) until the metal pipe (10) is deformed sufficiently to close the slot (18) to a desired width.

2. The method according to claim 1, further comprising the step of providing the roller (24) with a centering and a deformation controlling guide flange (26).

3. A method for making slots (18) in a metal pipe (10), the method comprising the steps of:

firstly, providing a metal pipe (10) having an exterior surface (12) and an interior surface (14), and the interior surface (12) defining an axially extending interior bore (16);

secondly, cutting with a cutting tool at least one axially extending elongate slot (18) through the exterior and interior surfaces (10, 12), the at least one axially extending elongate slot (18) having a width that is larger than desired in the metal pipe (10), the at least one axially extending elongate slot (18) providing fluid communication from an exterior of the metal pipe (10) to the interior bore (16), and the at least one axially extending elongate slot (18) having longitudinal peripheral edges (20) that are substantially coterminous with the exterior surface (12);

thirdly, applying pressure to the exterior surface (12) of the metal pipe (10) along each of the longitudinal peripheral edges (20) of the at least one axially extending elongate slot (18) via a roller having a first and second sloping contact surfaces (28) extending from respective opposing first and second outlying edges of the roller to a common contact surface midpoint, and the common contact surface midpoint having a diameter greater than said opposing first and second outlying edges; and fourthly, discontinuing the supply of pressure to the metal pipe (10) once the metal pipe (10) is sufficiently deformed to close the at least one axially extending elongate slot (18) to a desired width.

4. A method for making slots (18) in a metal pipe (10), the method comprising the steps of:

firstly, providing a metal pipe (10) having an exterior surface (12) and an interior surface (14), and the interior surface (12) defining an axially extending interior bore (16);

secondly, cutting with a cutting tool at least one axially extending elongate slot (18) through the exterior and interior surfaces (10, 12), the at least one axially extending elongate slot (18) having a width that is larger than desired in the metal pipe (10), the at least one axially extending elongate slot (18) providing fluid communication from an exterior of the metal pipe (10) to the interior bore (16), and the at least one axially extending elongate slot (18) having longitudinal peripheral edges (20) that are substantially coterminous with the exterior surface (12);

thirdly, applying pressure to the exterior surface (12) of the metal pipe (10) along each of the longitudinal peripheral edges (20) of the at least one axially extending elongate slot (18) via a roller having a first and second sloping contact surfaces (28) extending from respective opposing first and second outlying edges of the roller to a common contact surface midpoint, and the common contact surface midpoint having a diameter greater than said opposing first and second outlying edges;

fourthly, discontinuing the supply of pressure to the metal pipe (10) once the metal pipe (10) is sufficiently deformed to close the at least one axially extending elongate slot (18) to a desired width; and fifthly, controlling the deformation of the longitudinal peripheral edges (20) and the width of the at least one axially extending elongate slot (18) by providing the common contact surface midpoint with a centering and deformation controlling guide flange (26).

* * * * *